US011174067B2

(12) United States Patent
Antonellini et al.

(10) Patent No.: US 11,174,067 B2
(45) Date of Patent: Nov. 16, 2021

(54) CONTAINER INCLUDING TAMPER PROOF CLOSURE

(71) Applicant: Philip Morris Products S.A., Neuchatel (CH)

(72) Inventors: Vincent Antonellini, Bologna (IT); Bryan Foster, Le Mont-sur-Lausanne (CH); Luiz Andre Rodrigues, Neuchatel (CH); Onesio Luis Thesing, Curitiba (BR)

(73) Assignee: Philip Morris Products S.A., Neuchatel (CH)

( * ) Notice: Subject to any disclaimer, the term of this patent is extended or adjusted under 35 U.S.C. 154(b) by 13 days.

(21) Appl. No.: 16/761,411

(22) PCT Filed: Nov. 15, 2018

(86) PCT No.: PCT/EP2018/081451
§ 371 (c)(1),
(2) Date: May 4, 2020

(87) PCT Pub. No.: WO2019/096940
PCT Pub. Date: May 23, 2019

(65) Prior Publication Data

US 2021/0002023 A1 Jan. 7, 2021

(30) Foreign Application Priority Data

Nov. 15, 2017 (EP) ..... 17201937

(51) Int. Cl.
*B65D 5/66* (2006.01)
*B65D 5/54* (2006.01)

(52) U.S. Cl.
CPC ..... *B65D 5/6655* (2013.01); *B65D 5/5455* (2013.01); *B65D 5/6685* (2013.01)

(58) Field of Classification Search
CPC .. B65D 5/6655; B65D 5/5455; B65D 5/6685; B65D 5/542; B65D 5/5435; B65D 5/665; B65D 85/10564; B65D 5/5415
(Continued)

(56) References Cited

U.S. PATENT DOCUMENTS 5,511,722 A * 4/1996 Dixon ..... B65D 85/1045 229/225
8,020,697 B2 * 9/2011 Chatelain ..... B65D 5/422 206/273

(Continued)

FOREIGN PATENT DOCUMENTS

EP 2 099 685 B1 6/2014
GB 1 396 697 6/1975

(Continued)

OTHER PUBLICATIONS

International Search Report and Written Opinion dated Jan. 22, 2019 in PCT/EP2018/081451 filed Nov. 15, 2018.

*Primary Examiner* — Christopher R Demeree
(74) *Attorney, Agent, or Firm* — Oblon, McClelland, Maier & Neustadt, L.L.P.

(57) ABSTRACT

A container for consumer goods is provided, including a box to house the goods and having a box front wall, a box back wall, a box bottom wall, and box side walls, a top face of the box providing an access opening providing access to the goods; and a lid flap hingedly connected to the box back wall and including lid top and front walls, such that in a closed position of the flap the lid top and front walls overlie the access opening and the front wall, such that prior to a first opening of the container, the front wall is connected to each of the side walls along a line of weakness extending along a front edge of the respective side wall, and such that upon (Continued)

separation of the flap along the line, the flap is movable into an open position uncovering the access opening.

14 Claims, 7 Drawing Sheets

(58) Field of Classification Search
USPC ..... 229/100, 148, 160.1, 225, 234; 206/807; 221/302
See application file for complete search history.

(56) References Cited

U.S. PATENT DOCUMENTS

| | | | | |
|---|---|---|---|---|
| 2003/0230504 | A1* | 12/2003 | Hamming ..... | B65D 83/0805 206/389 |
| 2012/0111746 | A1* | 5/2012 | Tanbo ..... | B65D 77/02 206/268 |
| 2017/0240346 | A1* | 8/2017 | Chatelain ..... | B65D 5/4266 |
| 2017/0305650 | A1 | 10/2017 | Coulter et al. | |

FOREIGN PATENT DOCUMENTS

| | | | |
|---|---|---|---|
| WO | WO 03/053794 | A1 | 7/2003 |
| WO | WO 2011/116957 | A1 | 9/2011 |
| WO | WO 2014/146957 | A1 | 9/2014 |
| WO | WO 2016/055798 | A1 | 4/2016 |
| WO | WO 2019/106188 | A1 | 6/2019 |
| WO | WO 2019/115649 | A1 | 6/2019 |

* cited by examiner

CONTAINER INCLUDING TAMPER PROOF CLOSURE

The present invention relates to a container including a tamper proof closure and to a laminar blank for forming the container. Containers according to the invention find particular application as containers for aerosol-generating articles or components of aerosol-generating articles.

It is known to package aerosol-generating articles and other consumer goods in containers formed from folded laminar blanks. Consumer goods are commonly sold in containers having a box for housing the consumer goods and a lid connected to the box about a hinge line extending across a wall of the container. Such packs are typically constructed from laminar cardboard blanks. The lid may take the form of a simple lid flap or a three dimensional cup-shaped hinge lid. In use, the lid is pivoted about the hinge line to open the pack and expose an access opening in the box, through which the consumer can gain access to the consumer goods held within the box.

It is known to provide containers for consumer goods with tamper proof features so that consumers can readily see that the container has not been previously opened. For example, containers may incorporate tamper proof labels, seals or wrappers which need to be broken or removed prior to first opening of the container. However, such tamper proof features can be difficult to incorporate into containers using high speed manufacturing apparatus and methods. Furthermore, such tamper proof features often require the use of additional materials, which may be expensive and more difficult to handle.

It would be desirable to provide a container having a novel tamper proof closure which can be readily incorporated into a container without significantly affecting the construction and assembly of the container. It would be particularly desirable to provide such a container which can be efficiently manufactured using existing assembly apparatus and techniques without the need for significant modification. It would be further desirable to provide such a container having a novel tamper proof closure which can be conveniently opened by the consumer in order to access the contents of the container for the first time whilst retaining a secure closure of the container between uses.

According to the invention there is provided a container for consumer goods, the container comprising: a box for housing the consumer goods, the box comprising a box front wall, a box back wall, a box bottom wall and box side walls, wherein the top face of the box is at least partially open to provide an access opening for accessing the consumer goods; and a lid flap hingedly connected to the box back wall and comprising a lid top wall and a lid front wall, wherein in a closed position of the lid flap the lid top wall and the lid front wall overlie the access opening and the box front wall. Prior to first opening of the container, at least one wall of the lid flap is connected to a wall of the box along one or more lines of weakness, wherein upon separation of the lid flap from the box along the one or more lines of weakness, the lid flap is movable into an open position in which the access opening is uncovered.

According to the present invention there is further provided a laminar blank for forming a container for aerosol-generating articles according to the invention, as defined above, the laminar blank comprising: a box-defining portion comprising a box front wall panel, a box back wall panel, a box bottom wall panel and inner box side wall panels depending from each side edge of the box back wall panel; and a lid-defining portion depending from the box back wall panel, the lid-defining portion comprising a lid top wall panel and a lid front wall panel. The laminar blank further comprises an outer box side wall panel depending from each of the side edges of the lid front wall panel and connected to the lid front wall panel along a respective line of weakness.

The present invention in particular provides a container for consumer goods, the container comprising: a box for housing the consumer goods, the box comprising a box front wall, a box back wall, a box bottom wall and box side walls, wherein the top face of the box is at least partially open to provide an access opening for accessing the consumer goods; and a lid flap hingedly connected to the box back wall and comprising a lid top wall and a lid front wall, wherein in a closed position of the lid flap the lid top wall and the lid front wall overlie the access opening and the box front wall, wherein prior to first opening of the container, the lid front wall is connected to each of the box side walls along a line of weakness extending along the front edge of the respective box side wall, and wherein upon separation of the lid flap from the box along the line of weakness, the lid flap is movable into an open position in which the access opening is uncovered.

The present invention also particularly provides a laminar blank for forming a container for aerosol-generating articles according to the invention, the laminar blank comprising: a box-defining portion comprising a box front wall panel, a box back wall panel, a box bottom wall panel and inner box side wall panels depending from each side edge of the box back wall panel; and a lid-defining portion depending from the box back wall panel, the lid-defining portion comprising a lid top wall panel and a lid front wall panel, wherein the laminar blank further comprises an outer box side wall panel depending from each of the side edges of the lid front wall panel and connected to the lid front wall panel along a respective line of weakness extending along the front edge of the respective box side wall panel.

In the following description of the invention the terms "side", "top", "bottom", "front", "back" and other terms used to describe relative positions of the components of containers according to the invention refer to the container in an upright position with the access opening at the top. When describing containers according to the present invention, these terms are used irrespective of the orientation of the container being described. The "bottom" of the container refers to the side of the container opposite the "top" of the container. The "back" of the container refers to the side towards which the lid swings open.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "panel" is used herein to refer to a portion of the container formed from a single, continuous portion of material. A panel may depend from one or more other panels. The term "flap" refers to a panel that depends from only one other panel.

The term "wall" refers more generally to a facet of the container, and a wall may be formed from a single panel or flap, or a wall may be formed from two or more abutting or overlapping panels or flaps.

The term "depending" is used herein to describe a physical connection between two elements of a container in accordance with the invention. In more detail, the term "depending" is used to indicate that there is a material continuity between two elements, such as two walls or panels of a container or blank. This encompasses both cases wherein a wall or panel depends directly from an adjacent wall or panel as well as cases wherein an intermediate wall or panel effectively connects two walls or panels.

By way of example, a side wall or panel may depend directly from an adjacent front wall or panel. In such case, the wall or panel typically depends along a line of weakness from the adjacent wall. As an alternative, especially in containers having curved or bevelled edges, a side wall or panel may depend indirectly from a front wall or panel. In such case a curved or bevelled edge wall or panel connects the side wall or panel and the front wall or panel. In the case of a bevelled edge, both side wall or panel and front wall or panel may depend from the connecting bevelled edge wall or panel along respective fold lines. This also applies to optional components of containers in accordance with the invention, for example to a reinforcing member provided in the form of an inner frame.

As would be understood by one of skill in the art, a "bevelled edge portion", is used herein to refer to an edge portion of the container that has, as viewed in cross-section, one or more substantially straight shapes forming an angle between 0 and 90 degrees with the adjacent walls of the container.

The term "fold line" is used herein to describe any line of a blank about which the blank is folded. The fold line may be defined by a line of weakness to assist with the folding action. Alternatively, a fold can be formed without the presence of a weakening line, depending for example on the pliability of the blank material and other material characteristics.

The term "hinge line" is used herein to refer to a line about which a component of the container may pivot relative to another component. For example, the container comprises a hinge line which is the line about which the lid may be pivoted in order to open the container. A hinge line may also be provided in the dispensing means such that a portion of the dispensing means can be pivoted away from the consumer goods after dispensing, as described below. A hinge line may be, for example, a fold line or a score line.

In the containers according to the present invention, the connection of the lid flap to the box along one or more lines of weakness provides an effective tamper proof closure. The lid flap cannot be opened to access the consumer goods housed inside the box until the one or more lines of weakness have been broken by the consumer. This means that the consumer can readily confirm that the container has not been opened already. The consumer can conveniently break the one or more lines of weakness in order to open the lid flap simply by pulling the lid flap away from the box.

The breakage of the one or more lines of weakness will typically generate an audible sound, which advantageously provides the consumer with an indication that that the container is being opened for the first time. This can demonstrate to the consumer the integrity of the container and the freshness of the consumer goods within the container.

Advantageously, this tamper proof closure of the containers of the present invention can be integrated into the one or more laminar blanks for forming the container, so that additional tamper proof components are not required. This simplifies the construction of the container and also the process for assembling the container from the one or more laminar blanks.

After the lid flap has been separated from the box by breaking along the one or more lines of weakness, it can conveniently be used to reclose the container between uses.

As described above, the containers according to the present invention include a box which contains the consumer goods and a lid flap which is hingedly connected to the box back wall. Prior to first opening of the container, at least one wall of the lid flap is connected to a wall of the box along one or more lines of weakness. In this position, the lid flap is retained in the closed position and cannot be moved towards the open position until the one or more lines of weakness are broken. The one or more lines of weakness therefore provide the tamper proof closure of the container and the one or more lines of weakness will remain intact on a container that has not been tampered with.

The lid flap is preferably connected to the box along at least one of its free edges by a line of weakness. Preferably, the one or more lines of weakness substantially coincide with edges of the box. However, in certain embodiments, the one or more lines of weakness may extend across one or more faces of the box.

In a particularly preferred embodiment, the lid front wall of the lid flap is connected to each of the box side walls along a line of weakness extending along the front edge of the respective box side wall. The lid front wall therefore has a width substantially corresponding to the width of the box front wall and opposed lines of weakness are provided along the front vertical edges of the box. In such an embodiment, the lid flap may be opened by grasping the bottom edge of the lid front wall and pulling the lid front wall away from the box front wall to tear along the lines of weakness.

Alternatively or in addition to the provision of a line of weakness between the lid front wall and each of the box side walls, a line of weakness may be provided to connect the lid top wall to each of the box side walls. In this case, a line of weakness extends along the top edge of each of the box side walls.

The one or more lines of weakness are preferably in the form of a discontinuous cut line, such that the lid flap and the box are connected to each other at a plurality of connection points along the discontinuous cut line. The connection points, also known as holding points or nicks, are preferably between about 0.3 millimetres and about 0.6 millimetres in length. This ensures that the connection points are sufficiently long that they are not inadvertently opened prior to use, for example during the manufacturing process, whilst being sufficiently short that the opening of the lid flap by the consumer is not difficult.

The one or more lines of weakness could alternatively be in the form of a line of perforations, or a line along which the material has been weakened in another way, for example, a score line.

Containers according to the invention are preferably modified in some way to facilitate the grasping of the bottom edge of the lid front wall in order to open the lid flap for the first time.

In certain embodiments, the lid flap is constructed such that in the closed lid position, the bottom edge of the lid front wall is proximate the front edge of the box bottom wall, wherein the front edge of the box bottom wall is bevelled along at least part of its length.

The provision of a bevelled front edge effectively provides a space between the underside of the lid front wall and the outer surfaces of the box, into which the consumer can insert a finger or thumb so that the bottom edge of the lid front wall can be grasped on both sides. This enables the consumer to get a more secure hold on the lid flap so that it can be more readily pulled away from the box in order to break the one or more lines of weakness.

The front edge of the box bottom wall may be bevelled along the full length of the front edge. Alternatively, the front edge of the box bottom wall may be provided with a bevelled portion at each end, proximate the front corners of the box bottom wall. This facilitates the grasping of the lid front wall at the bottom corners. In a further alternative, the front edge of the box bottom wall may be provided with a central bevelled portion. This facilitates the grasping of the lid front wall towards the centre of the bottom edge. The provision of a central bevelled portion may be advantageous in embodiments in which the lid front wall is retained in a closed position by means of a central closure tab received into a slot on the box, as described below.

It will be appreciated by the skilled person that in alternative embodiments in which the lid flap has a different construction, it may be more appropriate to provide the bevelled edge along a different edge of the box in order to facilitate the opening of the lid flap.

Alternatively or in addition to the provision of a bevelled front edge of the box bottom wall, the box bottom wall of containers according to the present may comprise one or more recessed portions in which the box bottom wall is recessed into the box relative to the remainder of the box bottom wall. The one or more recessed portions are preferably provided proximate the bottom edge of the lid front wall. The provision of one or more recessed portions in the box bottom wall advantageously improves access to the bottom edge of the lid front wall so that the consumer can more easily grasp the lid front wall on both sides in order to open the lid flap.

It will be appreciated by the skilled person that in alternative embodiments in which the lid flap has a different construction, it may be more appropriate to provide the one or more recessed portions in a different wall of the box in order to facilitate the opening of the lid flap.

Alternatively or in addition to the provision of a bevelled edge or any recessed portions in the box bottom wall, the lid flap may further comprise one or more hinge lines extending across at least one of the bottom corners of the lid front wall such that the respective bottom corner can be folded upwards from the remainder of the lid front wall prior to first opening of the container. The provision of one or more hinge lines enables the bottom corner or corners of the lid front wall to be folded upwards and grasped by the consumer in order to pull the lid flap and break the lines of weakness. Preferably, the bottom corner or corners of the lid front wall that incorporate one or more hinge lines are not connected to the box along the edges of the corner. This means that the corners are free to be folded away from the box before the one or more lines of weakness are broken.

As described above, the lid flap of containers according to the invention is connected to the box back wall along a hinge line and comprises a lid top wall and a lid front wall. In the closed position of the lid flap, the lid top wall overlies the access opening at the top end of the box and the lid front wall overlies the box front wall. The lid front wall preferably has a height that substantially corresponds to the height of the box so that the lid front wall extends all of the way down the box front wall and the bottom edge of the lid front wall substantially coincides with the front edge of the box bottom wall, as described above. Alternatively, the lid front wall may extend only part way down the box front wall from the top end, provided the access opening is covered.

Preferably, the lid front wall comprises an inner lid front panel and an outer lid front panel, wherein the outer lid front panel is connected to the box along the one or more lines of weakness. With this arrangement, the outer panel provides the tamper proof connection between the lid flap and the box, whilst the inner panel provides additional reinforcement to the lid flap.

Preferably, the containers according to the present invention further comprise closure means for retaining the lid flap in a closed position after the lid flap has been separated from the box along the one or more lines of weakness.

The closure means may take any suitable form. In certain preferred embodiments, the closure means comprises a closure tab extending from an edge of the lid front wall and a corresponding slot in the box for receiving the closure tab when the lid flap is in the closed position. Preferably, the closure tab and a corresponding slot for receiving the closure tab are provided along the bottom edge of the container. Where a closure tab and corresponding slot are provided along the bottom edge of the container, it may be advantageous to incorporate a bevelled front edge on the box bottom wall, or a recessed portion in the box bottom wall adjacent the slot, as described above, to facilitate the opening of the lid flap. For example, where the slot to receive the closure panel is provided at the front edge of the box bottom wall, a portion of the box bottom wall adjacent the slot may advantageously be recessed relative to the remainder of the box bottom wall.

Where the lid front wall is formed of an inner front wall panel and an outer front wall panel, as described above, the closure tab may be defined by one or more lines of weakness in the inner front wall panel. The closure tab is therefore initially integral to the inner front wall panel and concealed inside the lid flap. The closure tab can then be separated from the remainder of the inner front wall panel by the consumer after the lid flap has been opened for the first time and can be used to secure the lid flap in the closed position between uses.

Alternatively or in addition to a closure tab, the container may be provided with a resealable structure that retains the lid flap in the closed position and enables repeated opening and closing of the lid flap between uses. For example, the closure means may comprise a microsuction structure, a resealable adhesive or a magnetised or magnetisable material in co-operation with one or more magnets provided between the contacting surfaces of the lid flap and the box.

The box of containers according to the invention is adapted to house the consumer goods. As described above, the top face of the box is at least partially open to provide the access opening through which the consumer goods within the box can be accessed. Preferably, the top end of the box is fully open in order to maximise the size of the access opening. In such embodiments, the box does not include a box top wall. In alternative embodiments, the box may comprise a box top wall and the access opening may be defined by a cut out in the box top wall. The access opening therefore only partially extends over the top face of the box.

The access opening may optionally extend part way down the box front wall. For example, a cut out may be provided at the top edge of the box front wall. This may advantageously improve access to the inside of the box when the lid is open. Where present, the cut out in the box front wall preferably extends at least one third of the way down the box front wall in order to optimise the access to the consumer goods. Where present, the cut out preferably has a width that is smaller than the width of the box so that the cut out does not extend across the full width of the container. This ensures that the structural rigidity of the box can be retained. The cut out may vary in shape. Preferably, the width of the cut out decreases with increasing distance from the top edge. The width of the cut out is therefore at a maximum adjacent the access opening. This facilitates the removal of the consumer goods whilst retaining the structural rigidity of the box.

In certain embodiments of the present invention, the access opening is incorporated into the container during the manufacturing process and is present when the lid is opened for the first time.

In alternative embodiments of the present invention, upon first opening the access opening is at least partially covered by a removable element which is at least partially removed by the consumer upon first opening of the lid flap, in order to gain access to the inside of the box. For example, upon first opening of the container the access opening may be at least partially covered by a removable portion of the box top wall or box front wall, defined by one or more lines of weakness. The lines of weakness may be configured to define a removable panel that is detachable from the box and is therefore intended to be fully removed by the consumer. Alternatively, the lines of weakness may be configured to define a removable panel that is removed from the access opening but remains attached to the box along at least one edge. For example, the removable panel may be removed and folded away from the access opening. In such cases, it may be possible for the consumer to move the removable panel back into the original position over the access opening between uses.

Alternatively, the removable element may be in the form of a removable cover layer, such as a removable adhesive label, that is provided over the access opening. In contrast to the removable panel, which is an integral part of the box top wall, the removable cover layer is a separate component that is applied onto the box to close the access opening. As with the removable panel described above, the removable cover layer may be configured to be detachable from the box. Alternatively, the removable cover layer may be configured such that it remains in place on the box. In such embodiments, the removable cover layer can preferably be reclosed or resealed over the access opening between uses. For example, the removable cover layer may comprise a resealable adhesive that enables it to be sealed back over the access opening. Alternatively, the removable cover layer may be slidable relative to the box such that it can be moved between a closed position over the access opening and an open position away from the access opening.

In certain embodiments in which a removable cover layer is provided, the removable cover layer may be connected to the lid flap in such a way that it is removed from the access opening automatically when the lid is opened. Alternatively or in addition, the removable cover layer may be attached to the lid flap such that the access opening is automatically reclosed by the removable cover layer when the lid flap is returned into the closed position.

Preferably, the side walls of the box of containers according to the invention are each formed from an inner side wall panel, an outer side wall panel and an intermediate side wall panel, which lies between the inner side wall panel and the outer side wall panel. This arrangement of three overlying panels for each side wall improves the rigidity of the container. Preferably, each of the intermediate side wall panels is provided with one or more cut outs. This enables direct contact between the surfaces of the corresponding inner side wall panel and outer side wall panel, through the one or more cut outs. As a result, the inner side wall panel and the outer side wall panel can be glued to each other directly. The advantage of such an arrangement is that when the box is formed from a single laminar blank, the three panels making up the side walls can be folded and glued together to form the side wall in a single step. This simplifies the assembly process and therefore improves the efficiency of the manufacturing of the container.

Preferably, a plurality of cut outs are provided along the height of the intermediate side wall panel in order to optimise the gluing of the side wall panels to each other all of the way up the box.

Containers according to the invention are preferably formed from one or more folded laminar blanks. The one or more laminar blanks may be formed from any suitable material or combination of materials including, but not limited to, cardboard, paperboard, plastic, metal, or combinations thereof. The different components of the container may be formed from the same material, or from different materials. Particularly preferably, the box and lid flap of the containers according to the invention are integrally formed from a single laminar blank.

Containers according to the invention may be formed from a single laminar blank according to the invention, as defined above. The laminar blank comprises a box-defining portion for forming the box of the container and a lid-defining portion for forming the lid flap, wherein the lid-defining portion depends from the box back wall panel. In order to provide the tamper proof closure of the present invention, the laminar blank comprises an outer box side wall panel depending from each of the side edges of the lid front wall panel and connected to the lid front wall panel along a respective line of weakness. When the laminar blank is assembled, the lines of weakness extend along the front vertical edges of the container and connect the lid flap to the box. In this way, the lines of weakness forming the tamper proof closure can be readily incorporated into the laminar blank, without impacting the overall construction of the laminar blank, or the assembly of the laminar blank into the container.

As described above, the inner side wall panels depend from each side edges of the box back wall panel. Preferably, the laminar blank further comprises intermediate side wall panels depending from each side edge of the box front wall panel. The arrangement of the intermediate side wall panels in the assembled container is described above with reference to the containers of the present invention. Preferably, each of the intermediate side wall panels is provided with one or more cut outs, to enable the direct connection of the inner side wall panel and the outer side wall panel, as described above.

Preferably, the panels of the laminar blank are arranged longitudinally, with the panels other than the side wall panels arranged end to end along the same line, so that the container can be assembled by folding the laminar blank and gluing the side wall panels together in a single step. The tamper proof closure will automatically be put into place upon assembly of the container, such that the assembly process does not require any modification.

Containers according to the present invention preferably comprise one or more elongate consumer goods within the box. Preferably, containers according to the invention comprise one or more aerosol-generating articles or aerosol-generating article components within the box. Containers according to the invention are particularly suitable for heated aerosol-generating articles that are intended for use in an aerosol-generating device comprising a heater element. Container according to the invention may alternatively be used for combustible smoking articles, or other types of heat-not-burn aerosol-generating articles. The aerosol-generating articles within the box may be wrapper together in a bundle, or individually in a packages or pouch.

Through an appropriate choice of dimensions, containers according to the invention may be designed to hold different types or numbers of aerosol-generating articles or other consumer goods.

The invention will now be further described, by way of example only, with reference to the accompanying drawings in which.

Figure 1:
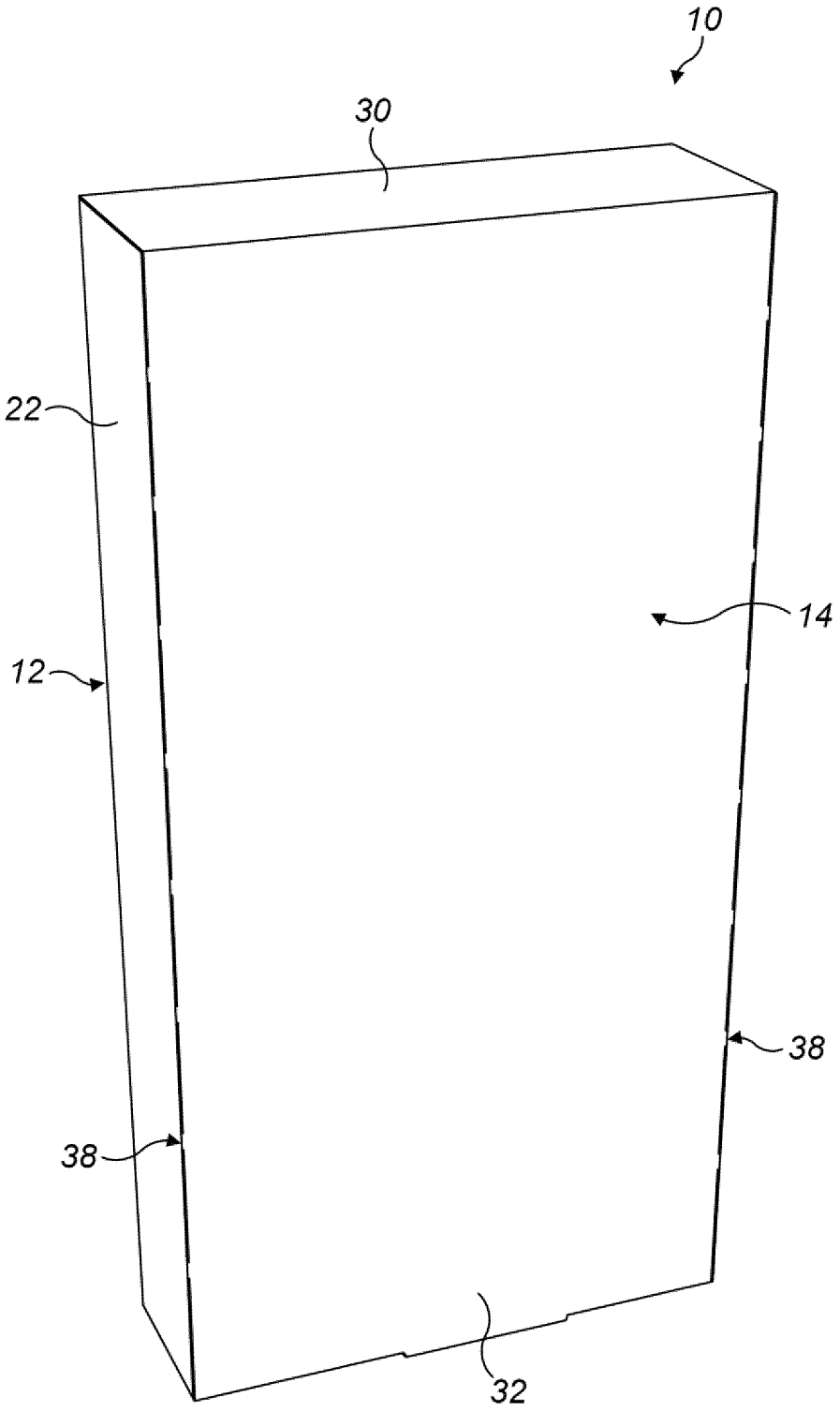
FIG. 1 shows a perspective view of a container according to a first embodiment of the invention, prior to first opening.

FIG. 1 shows a container 10 in accordance with a first embodiment of the invention, comprising a box 12 and a lid flap 14 connected to the box 12 along a hinge line 16. The box 12 is a rectangular parallelepiped and comprises a box front wall 18, a box back wall 20, a first box side wall 22, a second box side wall and a box bottom wall. The top end of the box 12 is open to provide the access opening of the container 10. A cut out 24 is provided at the top edge of the box front wall 18, adjacent the access opening. The cut out 24 is approximately trapezoidal in shape such that the width of the cut out 24 decreases with increasing distance from the access opening. The cut out 24 extends approximately 40 percent of the way down the box front wall 18. The box 12 houses a plurality of aerosol-generating articles 28 which are individually wrapped in pouches.

The lid flap 14 depends from the top edge of the box back wall 20 and comprises a lid top wall 30 and a lid front wall 32. In the closed position of the lid flap 14, the lid top wall 30 and the lid front wall 32 overlie the access opening at the top end of the box and the box front wall 18. The shape and size of the lid front wall 32 substantially corresponds to the shape and size of the box front wall 18 such that in the closed position the lid front wall 32 overlies the entire box front wall 18.

The lid front wall 32 is formed from an inner lid front wall panel 32*a* and an outer lid front wall panel 32*b*. The inner lid front wall panel 32*a* comprises a line of weakness defining a closure tab 34 adjacent the bottom edge of the inner lid front wall panel 32*a*. The closure tab 34 can be separated from the remainder of the inner lid front wall panel 32*a* upon first opening of the lid flap 14. An elongate slot 36 is provided at the front edge of the box bottom wall to receive the closure tab 34 when the lid flap 14 is in the closed position.

FIG. 1 shows the container 10 prior to first opening. In this position, the lid front wall 32 is connected to the first box side wall 22 and the second box side wall along lines of weakness 38 extending along the front vertical edges of the box 12. In order to open the container 10, the consumer must grasp the bottom edge of the lid front wall 32 and pull it away from the box 12 in order to break the lines of weakness 38.

Figure 2:
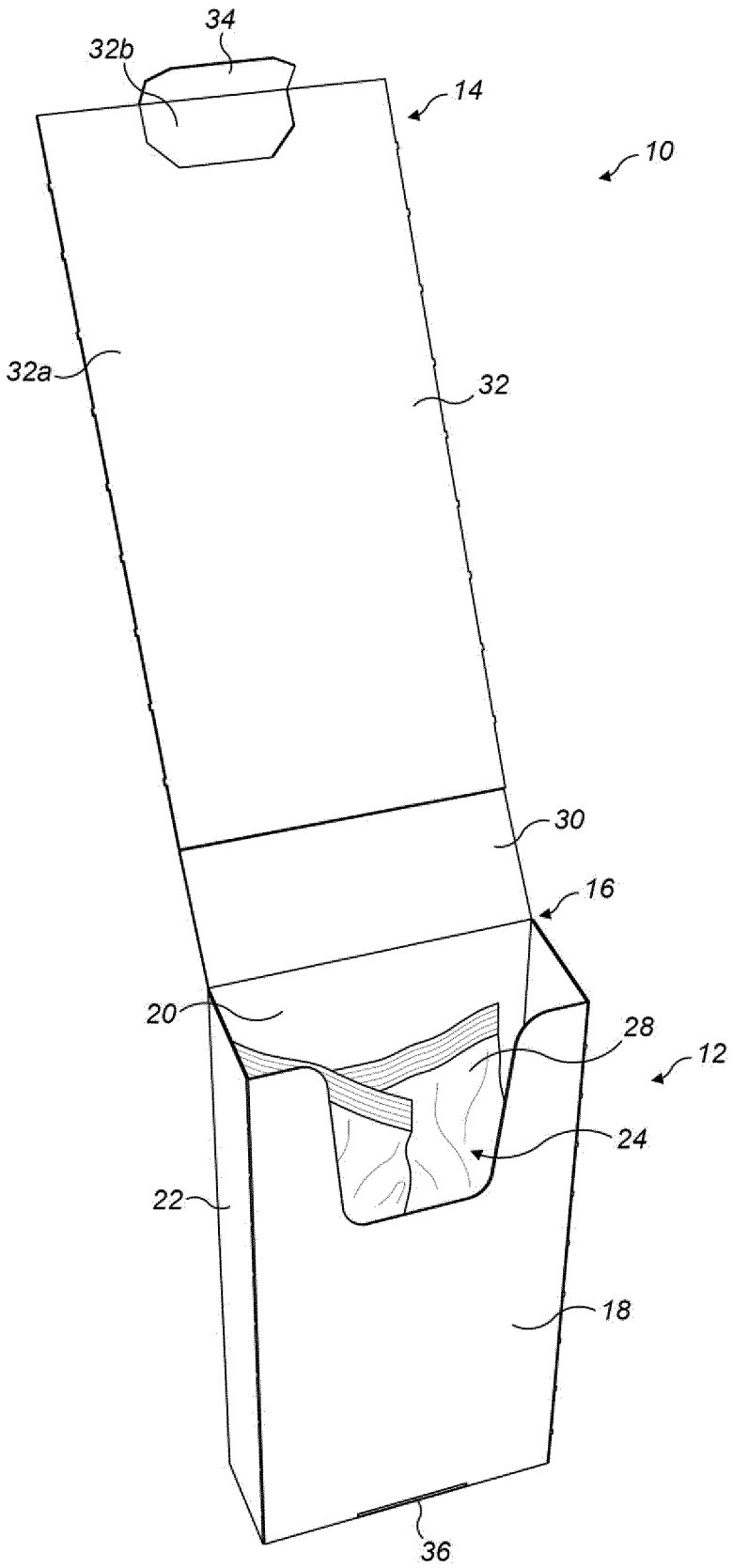
FIG. 2 shows a perspective view of the container of FIG. 1 after the first opening.

FIG. 2 shows the container 10 after the first opening of the lid flap 14. The lid front wall 32 has been separated from the box 12 by breaking the lines of weakness 38. The lid flap 14 has been pivoted away from the box 12 to expose the access opening in the top end of the box. The closure tab 34 has been pulled away from the inner lid front wall panel 32*a*. For subsequent closures of the lid flap 14, the closure tab 34 can be inserted into the slot 36 of the box 12 to retain the lid flap 14 in a closed position between uses.

Figure 3:
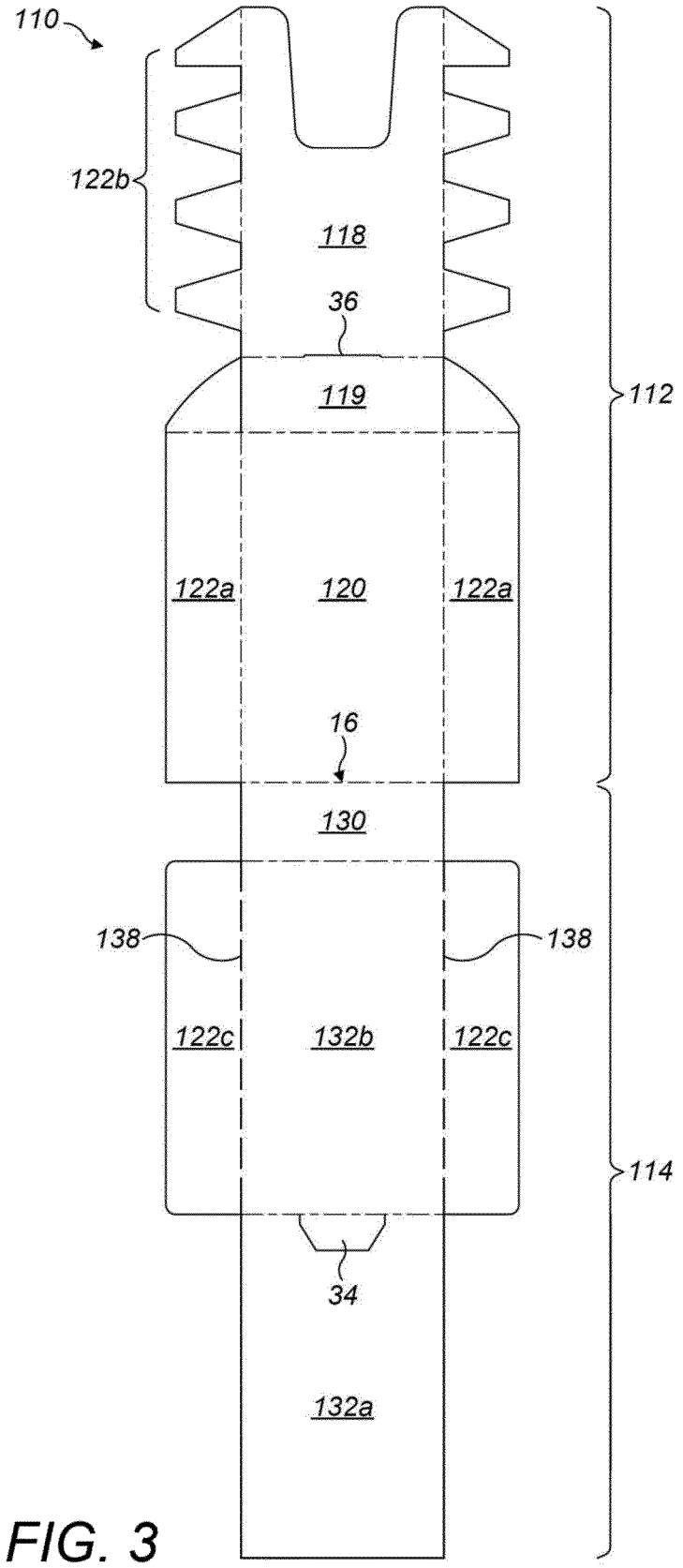
FIG. 3 shows a laminar blank for forming the container of FIGS. 1 and 2.

The box 12 and lid flap 14 are integrally formed from a single laminar blank. A suitable laminar blank 110 is shown in FIG. 3. In FIG. 3, the dashed lines indicate fold lines and the solid lines indicate cut lines. The laminar blank 110 comprises a box-defining portion 112 for forming the box 12 and a lid-defining portion 114 for forming the lid flap 14. The box-defining portion 112 and the lid-defining portion 114 are connected along a hinge line 16.

The box-defining portion 112 comprises a box front wall panel 118, a box bottom wall panel 119 and a box back wall panel 120 arranged longitudinally. An inner box side wall panel 122*a* depends from each side edge of the box back wall panel 120. An intermediate box side wall panel 122*b* depends from each side edge of the box front wall panel 118. Each intermediate box side wall panel 122*b* comprises three cut outs spaced apart along the height of the respective panel.

The lid-defining portion 114 comprises a lid top wall panel 130, an outer lid front wall panel 132*b* and an inner lid front wall panel 132*a* arranged longitudinally, along the same line as the panels of the box-defining portion. A line of weakness is provided at the bottom edge of the inner lid front wall panel 132*a* to define the closure tab 34. An outer box side wall panel 122*c* depends from each side edge of the outer lid front wall panel 132*b*. Each outer box side wall panel 122*c* is connected to the outer lid front wall panel 132*b* along a discontinuous cut line 138. Along each discontinuous cut line 138, the outer box side wall panel 122*c* and the outer lid front wall panel 132*b* are held together at a plurality of spaced apart connection points.

In order to assemble the container 10 from the laminar blank 110, the laminar blank is folded along each of the transverse fold lines and the respective inner side wall panels 122*a* and the outer side wall panels 122*c* are folded and glued together through the cut outs in the intermediate side wall panels 122*b* to seal the container 10. The aerosol-generating articles may be inserted into the container 10 after the initial step of folding the laminar blank 110, or the laminar blank 110 may be folded around the aerosol-generating articles.

Figure 4:
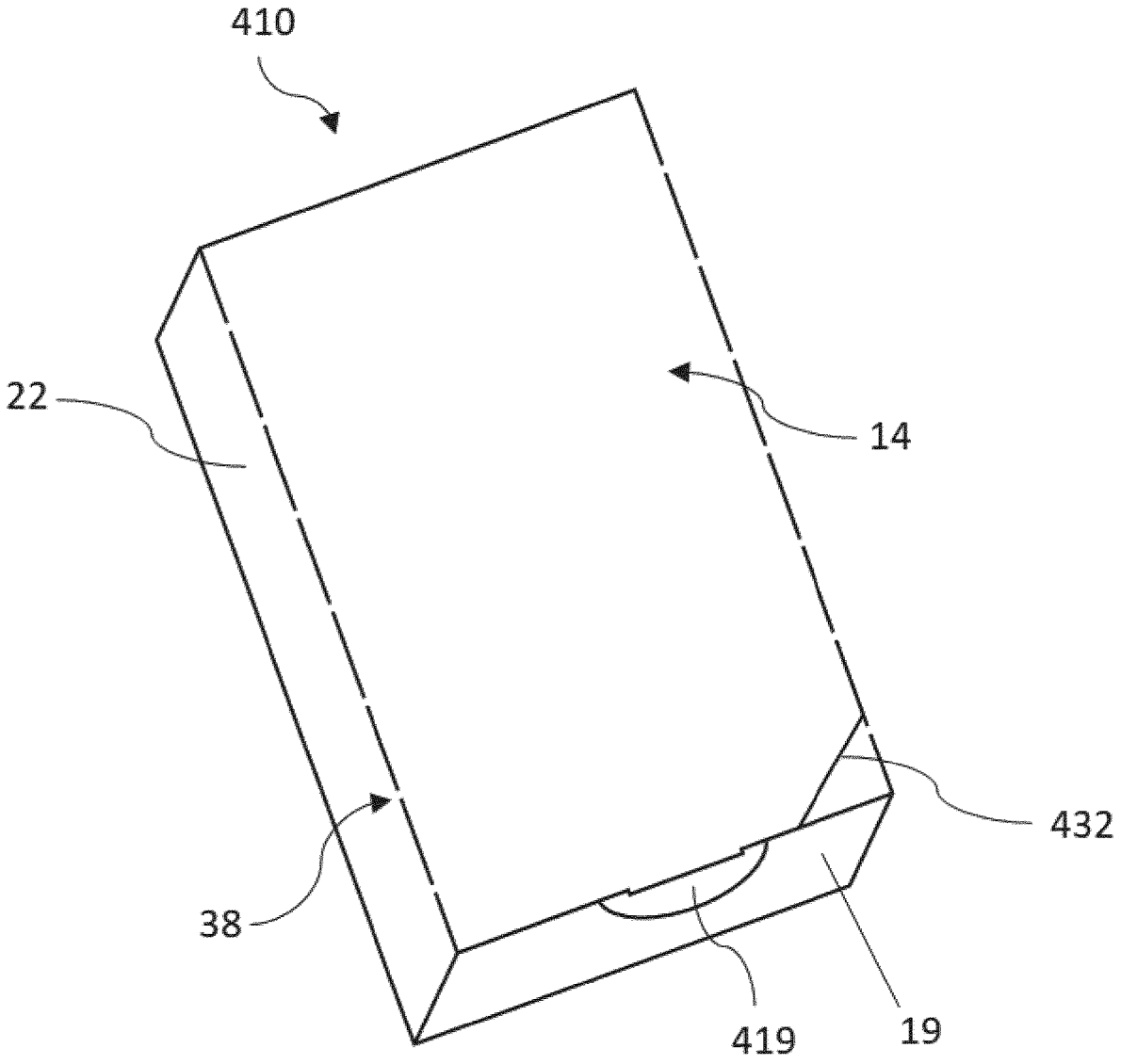
FIG. 4 shows a perspective view of a container according to a second embodiment of the invention, prior to first opening.

FIG. 4 shows a perspective view of a container 410 according to a second embodiment of the invention, prior to first opening. The container 410 of the second embodiment is substantially the same as the container 10 of the first embodiment. However, in the container 410 of the second embodiment the box bottom wall has a main planar portion 19 and a bevelled portion 419. In particular, the front edge of the box bottom wall is bevelled along at least part of its length. More specifically, the front edge of the box bottom wall is provided with a central bevelled portion 419.

As also shown in FIG. 4, the container 410 of the second embodiment of the invention, further comprises a hinge line 432 extending across one of the bottom corners of the lid front wall 32 such that said bottom corner can be folded upwards from the remainder of the lid front wall prior to first opening of the container 410.

Figure 5:
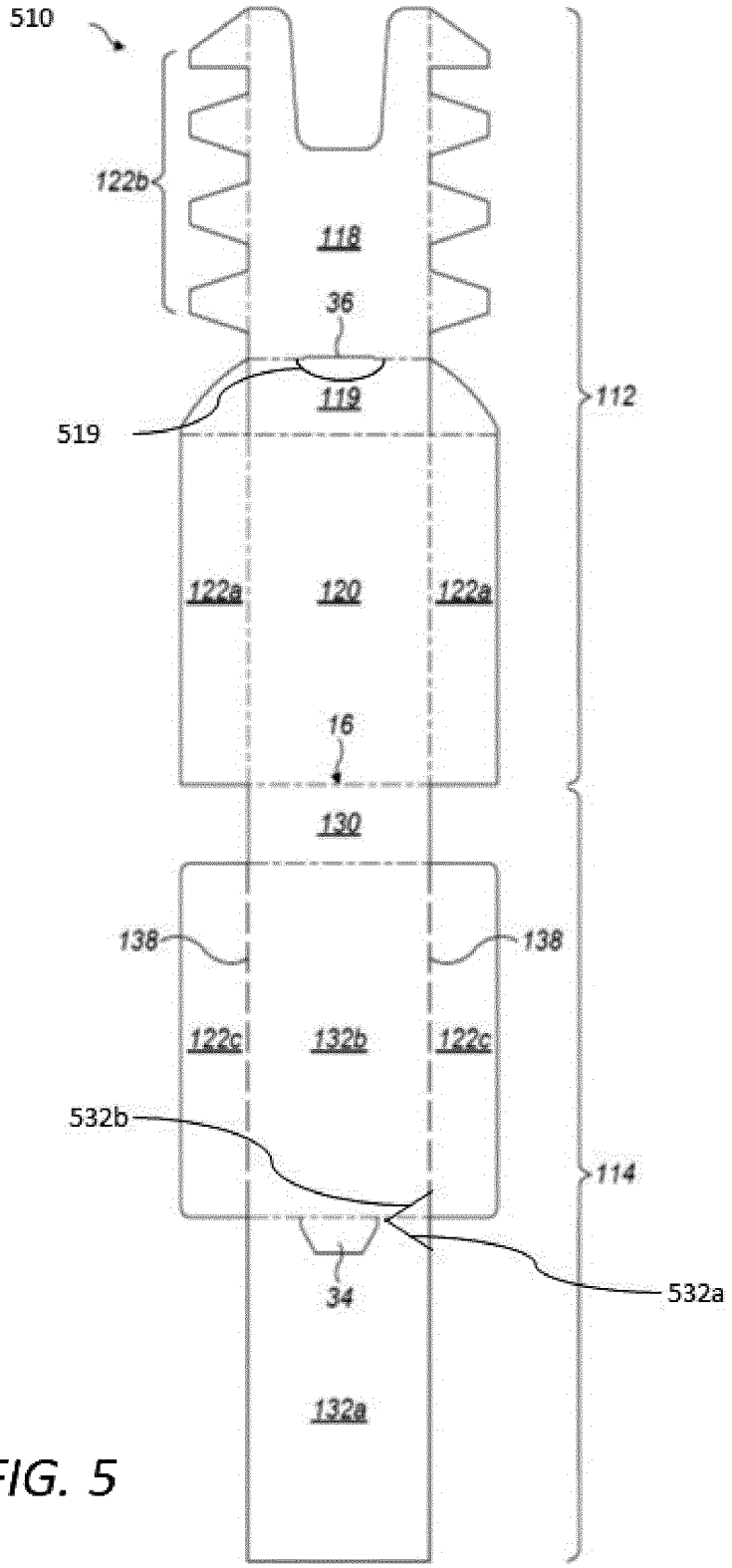
FIG. 5 shows a laminar blank for forming the container of FIG. 4.

FIG. 5 shows a laminar blank 510 for forming the container 410 of FIG. 4. The laminar blank 510 is substantially the same as the laminar blank 110 of the first embodiment. However, in laminar blank 510, an arcuate fold line 519 is provided on the box bottom wall panel 119 so as to help with formation of the central bevelled portion 419 of the box bottom wall during assembly of said container. As also shown in FIG. 5, a fold line 532*a*, 532*b* is provided respectively on each of the outer lid front wall panel 132*b* and an inner lid front wall panel 132*a* to define the hinge line 432 on the lid front wall 32 of FIG. 4.

Figure 6:
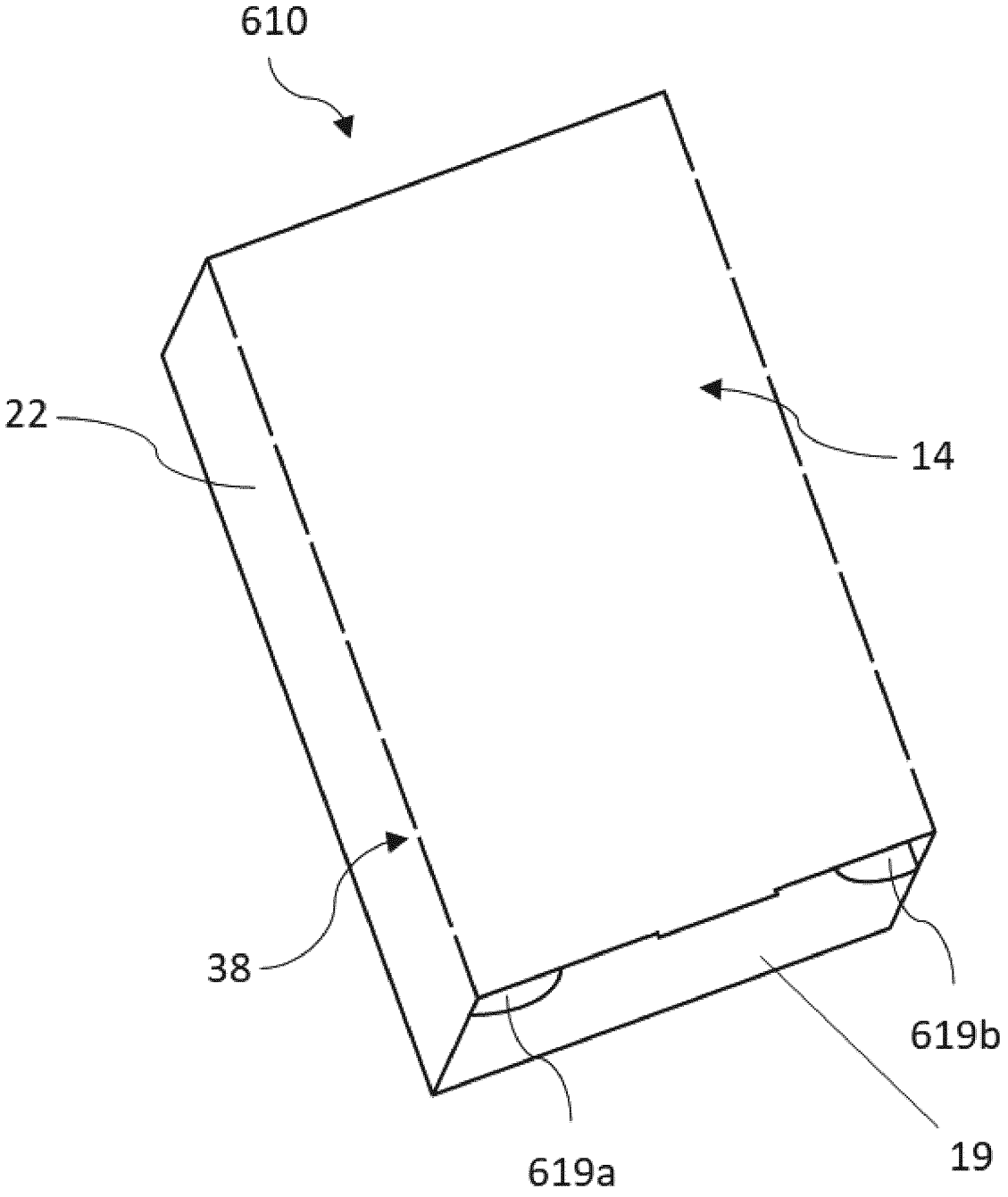
FIG. 6 shows a perspective view of a container according to a third embodiment of the invention, prior to first opening.

FIG. 6 shows a perspective view of a container 610 according to a third embodiment of the invention, prior to first opening. The container 610 of the third embodiment is substantially the same as the container 10 of the first embodiment. However, in the container 610 of the second embodiment the box bottom wall has a main planar portion 19 and two bevelled portions 619*a*, 619*b*. In particular, the front edge of the box bottom wall is bevelled along at least part of its length. More specifically, the front edge of the box bottom wall is provided with a bevelled portion 619*a*, 619*b* at each end, proximate the front corners of the box bottom wall.

Figure 7:
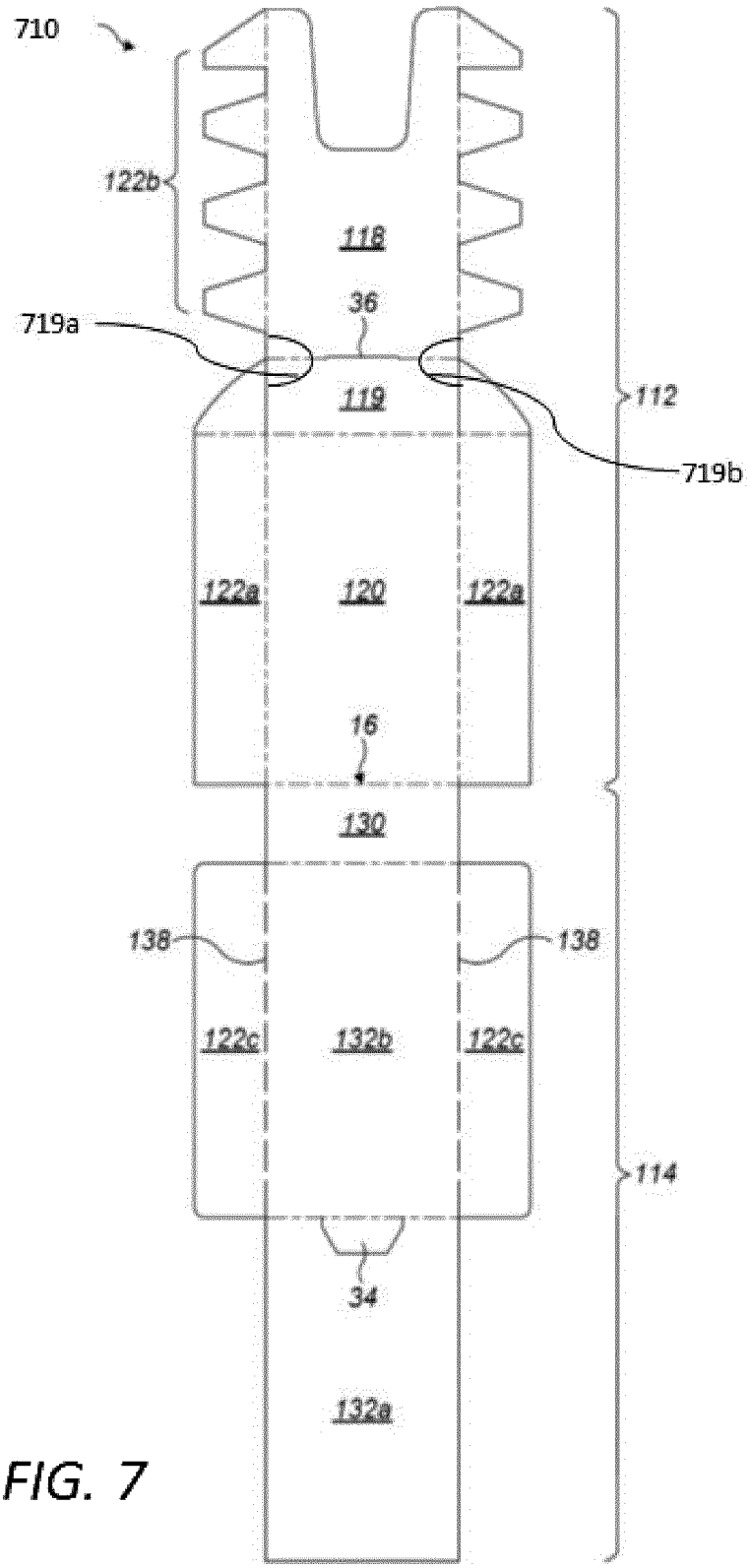
FIG. 7 shows a laminar blank for forming the container of FIG. 4.

FIG. 7 shows a laminar blank 710 for forming the container 610 of FIG. 6. The laminar blank 610 is substantially the same as the laminar blank 110 of the first embodiment. However, in laminar blank 610, arcuate fold lines 719*a*, 719*b* are provided on the box bottom wall panel 119 so as to help with formation of the two end bevelled portions 619*a*, 619*b* of the box bottom wall during assembly of said container.

The invention claimed is:

1. A container for consumer goods, the container comprising:

a box configured to house the consumer goods, the box comprising a box front wall, a box back wall, a box bottom wall, and box side walls, wherein a top face of the box is at least partially open to provide an access opening providing access to the consumer goods; and a lid flap hingedly connected to the box back wall and comprising a lid top wall and a lid front wall, wherein in a closed position of the lid flap the lid top wall and the lid front wall overlie the access opening and the box front wall, wherein prior to a first opening of the container, the lid front wall is connected to each of the box side walls along a line of weakness extending along a front edge of the respective box side wall, and wherein upon separation of the lid flap from the box along the line of weakness, the lid flap being movable into an open position in which the access opening is uncovered.

2. The container according to claim 1, wherein in the closed position of the lid flap, the bottom edge of the lid front wall is proximate the front edge of the box bottom wall, and wherein the front edge of the box bottom wall is beveled along at least part of a length thereof.

3. The container according to claim 2, wherein the front edge of the box bottom wall comprises a beveled portion adjacent each front corner of the box bottom wall.

4. The container according to claim 1, further comprising closure means for retaining the lid flap in a closed position after the lid flap has been separated from the box.

5. The container according to claim 4, wherein the closure means comprises a closure tab extending from an edge of the lid front wall and a corresponding slot in the box configured to receive the closure tab when the lid flap is in the closed position.

6. The container according to claim 5, wherein the lid front wall comprises a inner lid front wall panel and an outer lid front wall panel overlying the inner lid front wall panel, and wherein the closure tab is defined by a line of weakness in the inner lid front wall panel.

7. The container according to claim 5, wherein the corresponding slot is provided at the front edge of the box bottom wall, and wherein a portion of the box bottom wall adjacent the corresponding slot is recessed relative to a remainder of the box bottom wall.

8. The container according to claim 1, wherein the lid flap further comprises one or more hinge lines extending across at least one of bottom corners of the lid front wall such that a respective bottom corner can be folded upwards from a remainder of the lid front wall prior to the first opening of the container.

9. The container according to claim 1, wherein the container is formed from a single laminar blank.

10. The container according to claim 9, wherein each side wall comprises an inner side wall panel depending from the box back wall, an outer side wall panel depending from the lid front wall along the line of weakness, and an intermediate side wall panel provided between the inner side wall panel and the outer side wall panel, wherein the intermediate side wall panel depends from the box front wall, and wherein the intermediate side wall panel comprises one or more cut outs configured to permit direct contact between the inner side wall panel and the outer side wall panel through the one or more cut outs.

11. The container according to claim 1, wherein the line of weakness connecting the lid flap and the box is formed by a discontinuous cut line such that the lid flap and the box are connected to each other at a plurality of connection points along the discontinuous cut line.

12. The container according to claim 1, wherein a plurality of aerosol-generating articles is housed within the box.

13. A laminar blank for forming a container for aerosol-generating articles according to claim 1, the laminar blank comprising:

a box-defining portion comprising a box front wall panel, a box back wall panel, a box bottom wall panel, and inner box side wall panels depending from each side edge of the box back wall panel;

a lid-defining portion depending from the box back wall panel, the lid-defining portion comprising a lid top wall panel and a lid front wall panel; and an outer box side wall panel depending from each side edge of the lid front wall panel and connected to the lid front wall panel along a respective line of weakness extending along a front edge of the respective box side wall panel.

14. The laminar blank according to claim 13, further comprising intermediate side wall panels depending from said each side edge of the box front wall panel, wherein each of the intermediate side wall panels comprises one or more cut outs.

* * * * *